United States Patent [19]

Isozumi

[11] Patent Number: 5,036,213

[45] Date of Patent: Jul. 30, 1991

[54] COAXIAL ENGINE STARTER

[75] Inventor: Shuzoo Isozumi, Himeji, Japan

[73] Assignee: Mitsubishi Denki Kabushiki Kaisha, Tokyo, Japan

[21] Appl. No.: 481,259

[22] Filed: Feb. 20, 1990

[30] Foreign Application Priority Data

Feb. 20, 1989 [JP] Japan ..... 1-40634

[51] Int. Cl.[5] ..... F02N 11/00

[52] U.S. Cl. ..... 290/48; 74/6; 74/7 R; 310/88

[58] Field of Search ..... 74/6, 7 R; 290/48; 310/88

[56] References Cited

U.S. PATENT DOCUMENTS 4,553,442 11/1985 Mazzorana ..... 74/7 A
4,760,274 7/1988 Isozumi ..... 290/48
4,808,836 2/1989 Isozumi et al. ..... 290/48

FOREIGN PATENT DOCUMENTS 1311876 11/1962 France .

*Primary Examiner*—J. R. Scott
*Assistant Examiner*—Robert L. Hoover
*Attorney, Agent, or Firm*—Sughrue, Mion, Zinn, Macpeak and Seas

[57] ABSTRACT

The coaxial engine starter of the present invention comprises an electric motor having a rotary armature shaft and a yoke, a solenoid switch disposed behind the electric motor, an output rotary shaft disposed in front of the electric motor in an axially aligned relationship, and a planetary speed reduction gear disposed in front of and in axial alignment with the electric motor. The planetary speed reduction gear comprises a sun gear disposed on the motor armature shaft, a plurality of planetary gears disposed around the sun gear and an inner gear disposed around the planetary gears. The output rotary shaft has mounted thereon a pinion gear for engaging with an engine ring gear to be driven. The coaxial engine starter further comprises a front bracket assembly including a housing made of a resin material, the housing rotatably supporting the output rotary shaft and having integrally formed therein the inner gear of the planetary speed reduction gear, and a metallic mounting flange disposed around the housing for mounting the coaxial engine starter to the engine, the mounting flange being in direct electrical contact with the motor yoke.

4 Claims, 3 Drawing Sheets

COAXIAL ENGINE STARTER

BACKGROUND OF THE INVENTION

This invention relates to a coaxial engine starter and, more particularly, to a coaxial engine starter in which a solenoid switch, an electric motor and a pinion for driving an engine are axially aligned.

According to the conventional coaxial engine starter 10 shown in FIG. 1, a d.c. electric motor 1 has a hollow armature rotary shaft 2 and a plunger rod 4 of a solenoid switch 3 positioned at the rear end of the d.c. motor 1 is inserted into an inner passage 2*a* of the armature rotary shaft 2 so that the inserted front end of the plunger rod 4 abuts against the rear end of an output rotary shaft 5 coaxially disposed at the front end of the armature rotary shaft 2 and inserted into the inner passage 2*a* of the armature rotary shaft 2, whereby the output rotary shaft 5 can be pushed forward.

It is seen that a sun gear 10*a* is formed on the outer circumference of the front end of the armature rotary shaft 2 and a plurality of planetary gears 10*b* are in mesh with the sun gear 10*a*. These planetary gears 10*b* also mesh with an inner gear 9 formed in the inner circumferential surface of a front frame 13 and are rotatably supported by shafts 11 secured on a carrier 8. The sun gear 10*a*, the planetary gears 10*b*, the inner gear 9, the shafts 11 and the carrier 8 together constitute a planetary speed reduction gear 10 which reduces the rotational speed of the armature rotary shaft 2.

On the output rotary shaft 5, an over-running clutch 8 is fitted, of which a clutch inner member 8*b* is engaged with the output rotary shaft 5 by helical splines 5*c* of spline formation portion 5*b* having an outer diameter larger than the inner diameter of the inner passage 2*a* of the armature rotary shaft 2, so that the output rotary shaft 5 is allowed to axially slide while being rotated by the clutch inner member 8*b*. On the front end of the output rotary shaft 5, a pinion 6 which engages and disengages an engine ring gear (not shown) is mounted. When the output rotary shaft 5 is moved forward, the pinion 6 meshes with the engine ring gear to rotate the engine.

However, in the coaxial engine starter of the above construction, the front bracket 13 through which the starter is mounted to the engine is made of a metallic material such as die-cast aluminum alloy and has formed therein an inner gear 9 of the planetary speed reduction gear 10. Therefore, in order to constrict precision gear teeth to the inner gear 9, precise machining must be achieved to the front bracket 13. Also, another machining must be carried out to form a receptacle 14 for receiving and supporting a bearing 15 in the front bracket 13 as well as a stepped or a spigot joint between the front bracket 13 and the motor yoke 1. Further, the above-mentioned machining must be achieved for different front brackets of various design for different models or types of the engines to which the starter is to be mounted. Therefore, the number of manufacturing steps and the number of the kinds of parts are large.

Moreover, the front bracket 13, which supports the severe impacts on the bearing 15 upon the engagement of the pinion 6 into the engine ring gear and the hitting of the pinion 6 against the rotating engine ring gear, is entirely made of rigid metal which has substantially no shock-absorbing function. Therefore, the engine ring gear may be damaged or destroyed by the above mechanical impacts. Also, since the front bracket 13 is made of metal, the overall weight of the starter is relatively large, and the inner gear 9 formed in the front bracket 13 makes high metallic noise which degrades value as a commercial product.

SUMMARY OF THE INVENTION

Accordingly, one of the objects of the present invention is to provide a coaxial engine starter free from the above-discussed problems.

Another object of the present invention is to provide a coaxial engine starter in which the number and kinds of the parts are small and has a high productability.

Another object of the present invention is to provide a coaxial engine starter in which the mechanical shocks can be effectively absorbed.

Still another object of the present invention is to provide a coaxial engine starter which is low in noise.

A further object of the present invention is to provide a coaxial engine starter which is light in weight.

With the above objects in view, the coaxial engine starter of the present invention comprises an electric motor having a rotary armature shaft and a yoke, a solenoid switch disposed behind the electric motor, an output rotary shaft disposed in front of the electric motor in an axially aligned relationship, and a planetary speed reduction gear disposed in front of and in axial alignment with the electric motor. The planetary speed reduction gear comprises a sun gear disposed on the motor armature shaft, a plurality of planetary gears disposed around the sun gear and an inner gear disposed around the planetary gears. The output rotary shaft has mounted thereon a pinion gear for engaging with an engine ring gear to be driven. The coaxial engine starter further comprises a front bracket assembly including a housing made of a resin material, the housing rotatably supporting the output rotary shaft and having integrally formed therein the inner gear of the planetary speed reduction gear, and a metallic mounting flange disposed around the housing for mounting the coaxial engine starter to the engine, the mounting flange being in direct electrical contact with the motor yoke.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

Figure 1:
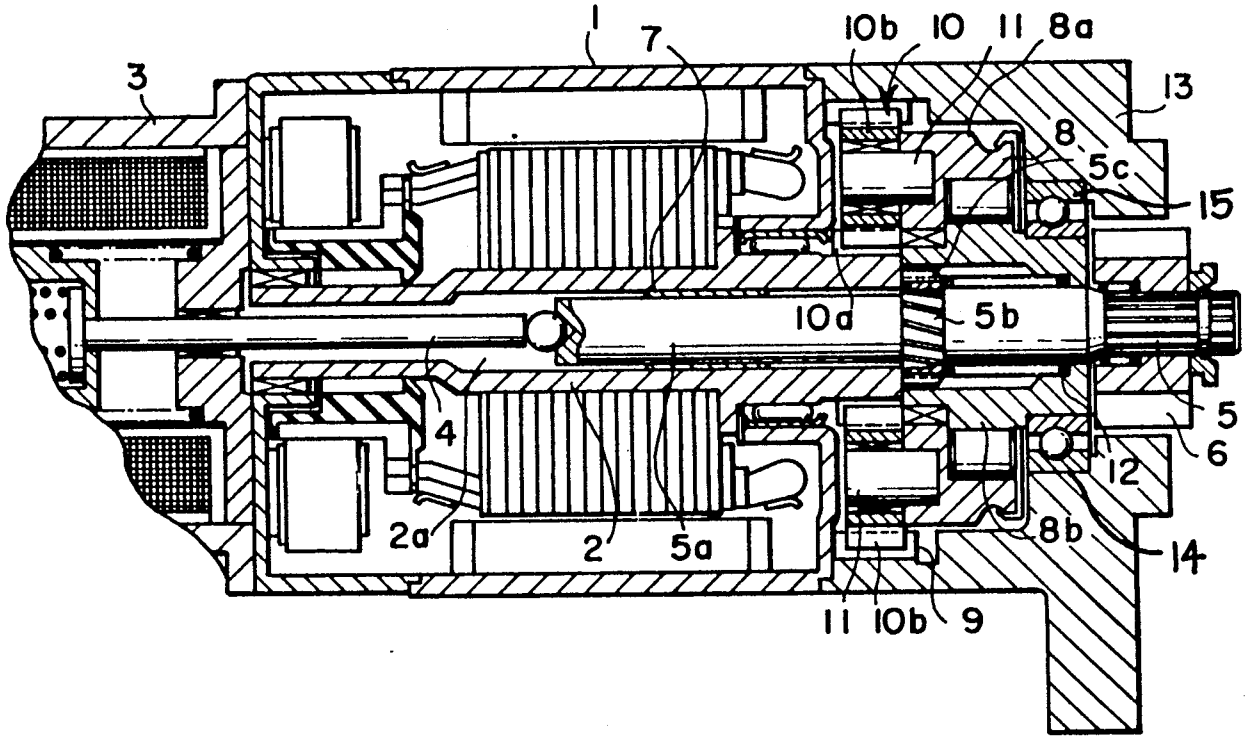
FIG. 1 PRIOR ART
FIG. 1 is a sectional view of the conventional coaxial engine starter.
Figure 2:
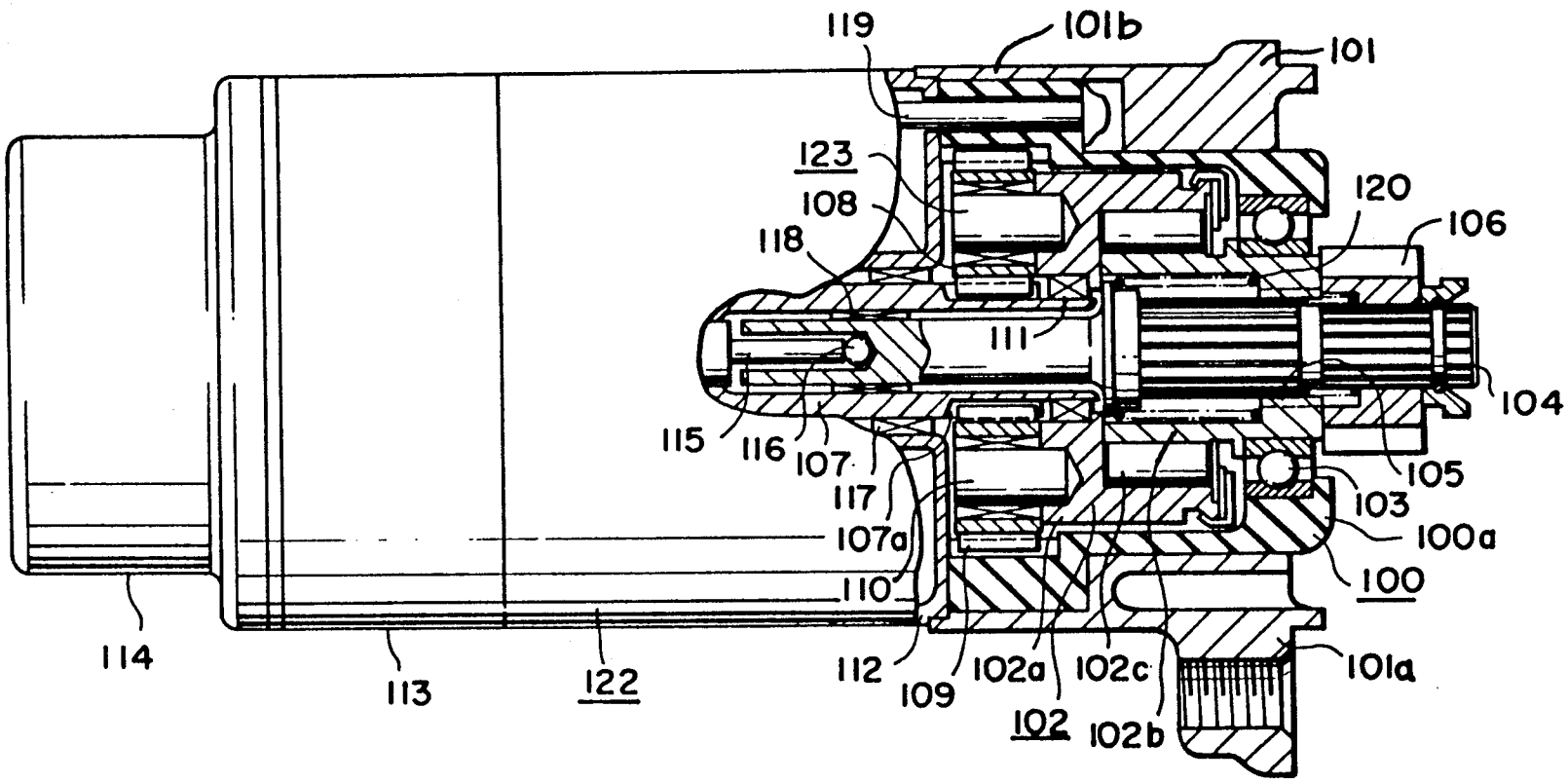
FIG. 2 is a partial sectional view of a coaxial engine starter of one embodiment of the present invention.

FIG. 2 illustrates one embodiment of the coaxial engine starter of the present invention in a partially sectional view. In FIG. 2, a coaxial engine starter of the present invention comprises an electric motor 122 having a hollow rotary armature shaft 107 rotatably supported by a bearing 117 which in turn is supported by a yoke 112, and a solenoid switch 114 attached to the rear portion of the electric motor 122 by a rear bracket 113. The coaxial engine starter also comprises an output rotary shaft 104 disposed in front of the electric motor 122 in an axially aligned relationship with the rotary armature shaft 107. It is seen that the rear end portion of the output rotary shaft 104 is inserted into the hollow front end portion of the rotary armature shaft 107 and is rotatably and axially slidably supported therein by a bearing 118. An actuator push rod 115 axially moved by the solenoid switch 114 is operatively associated with the output rotary shaft 104 through a steel ball 116.

A planetary speed reduction gear unit 123 is disposed in front of and in axial alignment with the electric motor 122. The planetary speed reduction gear unit 123 comprises a sun gear 107*a* formed on the outer circumference of the front end of the motor armature shaft 107, a plurality of planetary gears 108 disposed around and in mesh with the sun gear 107*a* and rotatably supported by pins 110 securely supported by a clutch outer member 102*a* of an over-running clutch 102, and an inner gear 109 disposed around the planetary gears 108 and formed in the inner circumference of a front bracket assembly 100 securely attached to the yoke 112 of the motor 122 by a plurality of through bolts 119.

The engine starter also comprises a pinion gear 106 mounted on the front end of the output rotary shaft 104 through splines 105 so that the pinion gear 106 can engage with a ring gear of an engine (not shown) to be driven.

In order to transmit the rotation of the motor 122 to the output rotary shaft 104 after the rotation is speed-reduced by the planetary speed reduction gear 123, and in order not to transmit the relative reverse rotation of the pinion 106 to the motor 122 when the engine is started, an over-running clutch 102 is disposed between the planetary speed reduction gear 123 and the output rotary shaft 104. The over-running clutch 102 comprises the clutch outer member 102*a* rotatably supported by a bearing 111 on the rotary armature shaft 107, a clutch inner member 102*b* slidably disposed on the output rotary shaft 104 and a plurality of friction rollers 102*c* disposed between the clutch outer member 102*a* and the clutch inner member 102*b*. The clutch inner member 102*b* is mounted on the output rotary shaft 104 and is axially slidable but not rotatable relative to the output rotary shaft 104 due to the splines 105 therebetween. A compression return spring 120 is disposed between the clutch inner member 102*b* and the output rotary shaft 104 to bias rearward the output rotary shaft 104. The outer circumference of the clutch inner member 102*b* is rotatably supported by the front end of the front bracket assembly 100 through a bearing 103.

According to the present invention, the front bracket assembly 100 comprises a substantially cylindrical, hollow resin inner housing 100*a* firmly attached to the front end of the yoke 112 by the bolts 119 for rotatably supporting the output rotary shaft 104 through the bearing 103 and a substantially cylindrical, hollow metallic outer housing or flange 101 disposed around the resinous housing 100*a* for mounting the coaxial engine starter to the engine (not shown). The mounting flange 101 is in direct electrical contact with the motor yoke 112.

The housing 100*a* has integrally formed therein the inner gear 109 of the planetary speed reduction gear 123. The housing 100*a* is made of a resinous material having sufficient mechanical strength and shock absorbing characteristics for withstanding and moderating large mechanical shocks or impacts generated upon the movements of the pinion 106 relative to the engine ring gear (not shown). The resinous material for the housing 100*a* may preferably be a plastic material including a resin reinforced by glass or a glass and an inorganic material for a superior mechanical strength, and the resin may most preferably be a phenolic resin for the superior creep resistance, the dimensional preciseness and moisture absorbing property.

The metallic mounting flange 101 which snugly fits around and supports the resinous housing 100*a* has a flange 101*a* through which the coaxial engine starter is securely mounted to the unillustrated engine by a suitable fastening means such as bolts (not shown). The metallic mounting flange 101 may be made by aluminum die-casting. The rear end of the metallic mounting flange 101*b* extends to reach the outer front corner of the metallic yoke 112 so that they directly abut in a spigot joint relationship. Since the metallic mounting flange 101*b* is also firmly secured to the yoke 112 by a plurality of through bolts (not shown) similar to the bolts 119, a direct electrical contact is established between the rear end of the metallic mounting flange 101 and the front end of the motor yoke 112. Therefore, a grounding circuit between the motor 122 and the engine can be provided without the need for an additional electrical wiring. Also, the cylindrical metallic mounting flange 101 serves as a protective cover for the resin housing 100*a* against rocks or the like that may hit the starter during the travelling of the vehicle.

Figure 3:
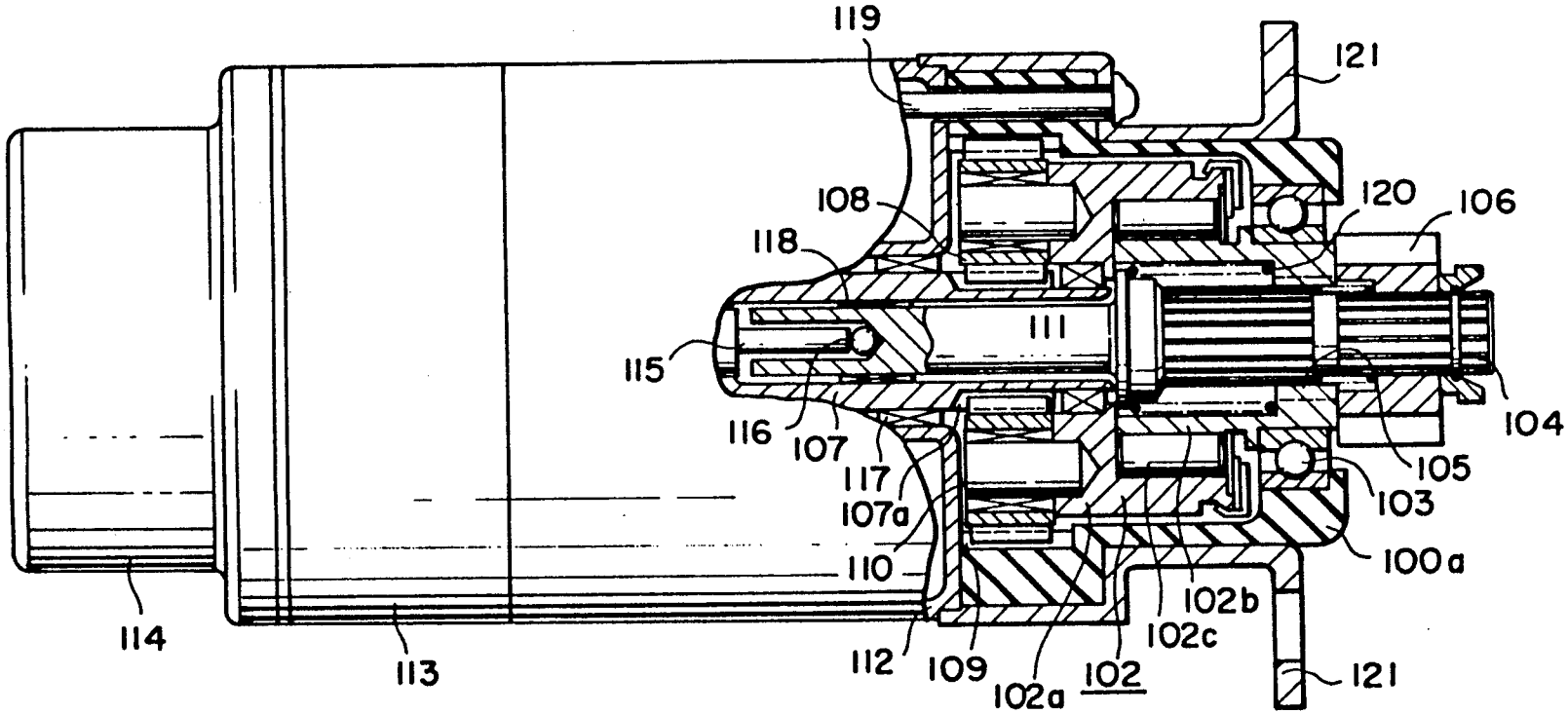
FIG. 3 is a partial sectional view of a coaxial engine starter of another embodiment of the present invention.

While the present invention has been described in conjunction with a particular preferred embodiment, many modifications can be made. For example, the mounting flange 101 shown in FIG. 2 can be replaced with a mounting flange 121 made of a press-formed steel plate as illustrated in FIG. 3. In other respects, the arrangement of the coaxial engine starter may be the same as that illustrated in FIG. 2. Alternatively, the resinous housing 100*a* may be integrally molded in the metallic mounting flange 101 or 121.

As has been described, the coaxial engine starter of the present invention comprises an electric motor having a rotary armature shaft and a yoke, a solenoid switch disposed behind the electric motor in an axially aligned relationship, and a planetary speed reduction gear disposed in front of and in axial alignment with the electric motor. The planetary speed reduction gear comprises a sun gear disposed on the motor armature shaft, a plurality of planetary gears disposed around the sun gear and an inner gear disposed around the planetary gears. The output rotary shaft has mounted thereon a pinion gear for engaging with an engine ring gear to be driven. The coaxial engine starter further comprises a front bracket assembly including a housing made of a resin material, the housing rotatably supporting the inner output rotary shaft and having integrally formed therein the inner gear of the planetary speed reduction gear, and a metallic mounting flange disposed around the housing for mounting the coaxial engine starter to the engine, the mounting flange being in direct electrical contact with the motor yoke.

Therefore, a precision inner gear can be formed by molding without the need for additional time-consuming machining, and the forming of the receptacle for the bearing can also be simultaneously achieved with the forming of the inner gear. Therefore, the number of manufacturing steps and the number of the kinds of parts can be decreased. Further, the front bracket assembly, which supports the severe impacts on the bearing upon the engagement of the pinion into the engine ring gear and the hitting of the pinion against the rotating engine ring gear, includes the resin housing made of the shock-absorbing resin material. Therefore, the engine ring gear is prevented from being damaged or destroyed by the above mechanical impacts. Also, since the front bracket assembly is partly made of resin, the overall weight of the starter can be reduced as compared to the conventional design. Finally, since the inner gear is formed by a resinous material, gear noise can be significantly reduced.

What is claimed is:

1. A coaxial engine starter comprising:

an electric motor having a rotary armature shaft and a yoke;

a solenoid switch disposed behind said electric motor;

an output rotary shaft disposed in front of said electric motor in an axially aligned relationship;

a planetary speed reduction gear unit disposed in front of and in axial alignment with said electric motor, said planetary speed reduction gear unit having a metal sun gear disposed on said motor armature shaft, a plurality of metal planetary gears disposed around said sun gear, and a stationary inner gear made of a resinous material disposed around said planetary gears;

a pinion gear mounted on said output rotary shaft for rotation therewith and for engaging with an engine ring gear to be driven;

a hollow inner housing made of a resinous material, said inner housing having an axial opening at an outermost end thereof through which said output rotary shaft extends, said inner housing rotatably supporting said output rotary shaft via bearing means disposed in said opening, and having integrally formed in an innermost end thereof said stationary inner gear of said planetary speed reduction gear unit; and a generally cylindrical, metallic outer housing disposed surrounding said resinous inner housing and having a mounting flange for mounting said coaxial engine starter to the engine, said outer housing being in direct electrical contact with said motor yoke.

2. A coaxial engine starter as claimed in claim 1, wherein said resinous material comprises a phenolic resin.

3. A coaxial engine starter as claimed in claim 1, wherein said outer housing is made of a die-cast metallic material.

4. A coaxial engine starter as claimed in claim 1, wherein said outer housing is made of a press-formed steel plate.

* * * * *